US005540643A

United States Patent [19]

Fontaine

[11] Patent Number: 5,540,643

[45] Date of Patent: Jul. 30, 1996

[54] BACK STRETCHING APPARATUS

[76] Inventor: Raymond E. Fontaine, 3550 Galt Ocean Dr., Ft. Lauderdale, Fla. 33308

[21] Appl. No.: 380,282

[22] Filed: Jan. 30, 1995

[51] Int. Cl.[6] ..... A63B 23/02

[52] U.S. Cl. ..... 482/143; 482/904; 482/907; 602/36

[58] Field of Search ..... 482/67, 96, 143, 482/904, 907; 602/36; 606/241

[56] References Cited

U.S. PATENT DOCUMENTS

| | | | |
|---|---|---|---|
| 864,188 | 8/1907 | Patterson | 482/143 |
| 3,662,750 | 5/1972 | Jorgensen . | |
| 3,896,798 | 7/1975 | Simon | 482/41 |
| 4,205,665 | 6/1980 | Burton . | |
| 4,419,990 | 12/1983 | Forster . | |
| 4,662,629 | 5/1987 | Plovie | 482/904 |
| 4,838,250 | 6/1989 | Angelo | 602/36 |
| 4,844,448 | 7/1989 | Niznik | 482/904 |
| 4,895,328 | 1/1990 | Ryan . | |
| 5,135,445 | 8/1992 | Christensen et al. | 482/904 |
| 5,217,488 | 6/1993 | Wu . | |
| 5,224,924 | 7/1993 | Urso . | |
| 5,242,380 | 9/1993 | Steinbrueck . | |

FOREIGN PATENT DOCUMENTS

| | | | |
|---|---|---|---|
| 2611135 | 8/1988 | France | 602/36 |

*Primary Examiner*—Richard J. Apley
*Assistant Examiner*—Jeanne M. Clark
*Attorney, Agent, or Firm*—Oltman and Flynn

[57] ABSTRACT

An apparatus for creating traction in a user back and is securable to an apparatus support structure having an apparatus engaging rim and an apparatus upright support face includes an elongate suspension member having a first member end and a second member end, a hook structure extending from the first member end in a first lateral direction for engaging the engaging rim, a support arm secured to and extending from the suspension member in a second lateral direction substantially opposite from the first lateral direction to project away from the upright support face, so that downward loading on the arm member causes the suspension member to pivot on the hook structure to abut and find support against the upright support face. A method of performing traction exercises using the above-described apparatus includes the steps of hooking two of the suspension members over an elevated portion of the support structure so that the members are laterally spaced apart from each other, placing the user back against the support structure between the suspension members, raising the user arms over and around the support arms and bending and transferring user weight from the user legs to the support arms, thereby causing the weight of the user torso and user legs to pull downward on the user spine to create traction.

3 Claims, 2 Drawing Sheets

BACK STRETCHING APPARATUS

BACKGROUND OF THE INVENTION

1. Field of the Invention

The present invention relates generally to the field of traction devices for applying tension to the spine. More specifically the present invention relates to a back stretching apparatus including an elongate suspension member having first member end and a second member end. A hook structure extends from the first member end in a first lateral direction for engaging an elevated portion of an apparatus support structure, such as the top of a door or partition wall, so that the suspension member hangs vertically. A support arm for supporting a user extends from the suspension member in a second lateral direction opposite from the first lateral direction to project away from the door or wall. Downward loading on the arm member causes the suspension member to pivot slightly on the hook structure to abut and find support against the door or wall. A sleeve of padding material preferably covers the support arm to provide comfort for the user. The suspension member is preferably formed of two telescoping tubular segments interconnected by a removable pin diametrically fit through mutually aligned pin ports in the tubular segments. A periodic series of opposing pin ports are provided in one of the tubular segments to make the tubular segments mutually engagable at a variety of discrete telescopic positions, to accommodate users of various heights. The second end of the suspension member is preferably fitted with a protective cap to prevent scratching of the door during use and upon which the apparatus rests when standing in storage, such as on a closet floor between uses.

A method of apparatus use is also provided, including the steps of hooking two of the apparatus over an elevated portion of a support structure such that the suspension members are horizontally spaced apart from each other by a distance substantially equivalent to the width of a user torso or rib cage, placing the user back against the support structure between the suspension members, raising the user arms over and around the apparatus support arms and transferring user weight from the user legs to the apparatus support arms, thereby causing the weight of the user torso and user legs to pull downward on the spine and create traction. The user transfers user weight from the user legs to the apparatus support arms either by bending his or her knees or stepping off a prop such as a stool.

2. Description of the Prior Art

There have long been devices for exerting traction on the back of a device user.

One such device is that of Steinbrueck, U.S. Pat. No. 5,242,380, issued on Sep. 7, 1993, disclosing an orthopedic arm pit engaging harness. The Steinbrueck harness fits around the rib cage and under the arm pits of the user and is secured by long straps to an elevated support. The weight of the user is borne at the arm pits to place the user back in traction. A problem with Steinbrueck is that the harness is not conveniently secured to a common structure such as a door, but is somehow fastened to a ceiling. This makes Steinbrueck unsuitable for use during travel at hotels or for use in most offices. Another problem with Steinbrueck is that the structure is complex and time consuming to strap to the body for use.

Jorgensen, U.S. Pat. No. 3,662,750, issued on May 16, 1972, reveals a traction apparatus. Jorgensen takes the form of a partial parallelepiped frame having a harness and harness winch at one end. The user mounts the frame from any of various possible body abutment positions, engages the head or a limb with the harness and then applies traction with the winch. A problem with Jorgensen is that there is no convenient way to apply traction to the spine, particularly to the lower lumbar area. Another problem is that the user must go through the time and inconvenience of securing the harness around a body segment and operating the winch. Other problems are that Jorgensen is bulky, complicated and relatively expensive.

Burton, U.S. Pat. No. 4,205,665, issued on Jun. 3, 1980, teaches a gravity lumbar reduction method and apparatus. A mattress and mattress support frame are mounted diametrically across two parallel, concentric and spaced apart support hoops. The hoops are rotatably mounted in a base frame so that the mattress may be rotated to any of various tilt positions. A harness is secured to a harness frame connected to the hoops at the head of the mattress for engaging the torso of a user. Once the harness is secured about the user, the hoops are rotated about their common central axis to tilt the mattress and thereby cause the weight of user legs and torso to exert traction on the user back. Alternatively the mattress is secured onto a tilt board. A problem with Burton is that the apparatus is far too cumbersome and heavy for user transport to and assembly in hotels and offices. Furthermore, Burton is too large to kept in most homes and is inconvenient to use, Another problem is that Burton is complex and expensive beyond the means of many potential users.

Forster, U.S. Pat. No. 4,419,990, issued on Dec. 13, 1983, discloses an apparatus for relieving the spinal column. Forster includes a bracket for engaging the top of a door having a pair of oppositely extending pegs spaced outwardly from and parallel to the face of the door and located near the top of the door, with padded rollers fitted over them. The user fits each foot over a roller and hangs upside down from the apparatus to apply traction to the spine. A problem with Forster is that hanging upside down is dangerous. If the user falls, a severe neck injury could result. Another problem with Forster is that it is difficult to mount and dismount, and may require the help of another person each time it is used.

Ryan, U.S. Pat. No. 4,895,328, issued on Jan. 23, 1990, discloses a therapeutic device for sufferers of back pain. Ryan includes essentially a crane structure having a support base, an upright member and a cantilever member extending laterally from the top of the upright member, and a lifting cable. The lifting cable extends down from the free end of the cantilever member to a cradle structure having two support arms. The user sits in a chair and rests his or her arms on the support arms, and then operates controls to lift the cradle and thereby apply traction force to his or her back. The problems of Burton are again presented.

Wu, U.S. Pat. No. 5,217,488, issued on Jun. 8, 1993, teaches a motor-operated traction device. The user lies on a horizontal bed and armpit engaging members hold his or her upper torso in position. Then a belt is secured around the user waist and a motor and linkage assembly pulls on straps connected to the belt to cause tension in the user spine. Problems with Wu are that it is cumbersome, awkward to use, complicated and expensive.

Urso, U.S. Pat. No. 5,224,924, issued on Jul. 6, 1993, discloses a back treatment device. Urso includes a pair of adjustable crutches for supporting the upper body of a user. Each crutch includes an air-inflatable underarm member for comfort. A pair of adjustable forearm rests and paddle handles are positioned such that a handle and rest are located laterally with respect to a corresponding crutch. The three pairs are movably supported such that the user can be alternately supported on each pair or on combinations of pairs. By slightly depressing his or her shoulders, the patient uses the body support members to induce spinal traction. The problems of Wu and Burton are again presented.

It is thus an object of the present invention to provide a back traction apparatus which is simple in design, and easy and fast to set up, take down and use.

It is another object of the present invention to provide such an apparatus which is light weight and very compact for convenient transport in an automobile and for storage in a house or office closet.

It is still another object of the present invention to provide such an apparatus which is durable, safe and reliable.

It is finally an object of the present invention to provide such an apparatus which is very inexpensive to manufacture, so that its benefits are within the financial reach of virtually all patients in need of traction.

SUMMARY OF THE INVENTION

The present invention accomplishes the above-stated objectives, as well as others, as may be determined by a fair reading and interpretation of the entire specification.

An apparatus is provided for creating traction in a user back and is securable to an apparatus support structure having an apparatus engaging rim and an apparatus upright support face, including an elongate suspension member having a first member end and a second member end, a hook structure extending from the first member end in a first lateral direction for engaging the engaging rim, a support arm secured to and extending from the suspension member in a second lateral direction substantially opposite from the first lateral direction to project away from the upright support face, so that downward loading on the arm member causes the suspension member to pivot on the hook structure to abut and find support against the upright support face. The suspension member preferably includes two telescoping tubular segments interconnected by a removable securing mechanism for engagement at several discrete telescopic positions, to accommodate users of various heights. The removable securing mechanism preferably includes a securing pin, and several diametrically opposing pairs of pin ports for receiving the securing pin at the several discrete telescopic positions. The apparatus preferably additionally includes padding on the support arm for increased comfort of apparatus users. The support structure may be a door and the engaging rim the door top.

An apparatus is also provided for creating traction in a user back and which is securable to a wall of a building, including an elongate suspension member having first member end and a second member end, a wall engaging structure secured to the first member end for securing the suspension member to the wall in a first lateral direction, and a support arm secured to and extending from the suspension member in a second lateral direction substantially opposite from the first lateral direction to project away from the upright support face, so that downward loading on the arm member causes the suspension member to pivot on the hook structure to abut and find support against the wall. The removable securing mechanism preferably includes a securing pin, and several diametrically opposing pairs of pin ports for receiving the securing pin at the several discrete telescopic positions.

A method is provided of performing traction exercises using the above described apparatus, including the steps of hooking two of the suspension members over an elevated portion of the support structure so that the members are laterally spaced apart from each other, placing the user back against the support structure between the suspension members, raising the user arms over and around the support arms and bending and transferring user weight from the user legs to the support arms, thereby causing the weight of the user torso and user legs to pull downward on the user spine to create traction. The user may transfer weight from the user legs to the apparatus support arms by bending the user knees or by stepping off a user foot support structure.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 2:
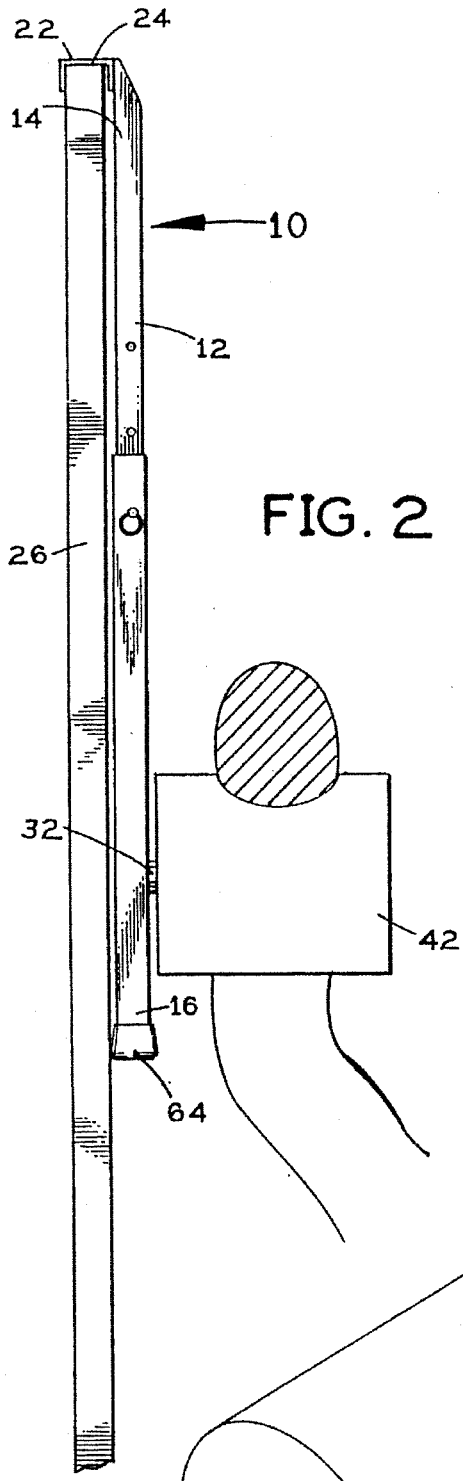
FIG. 2 is a side schematic loading diagram of the apparatus mounted on a door.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 1:
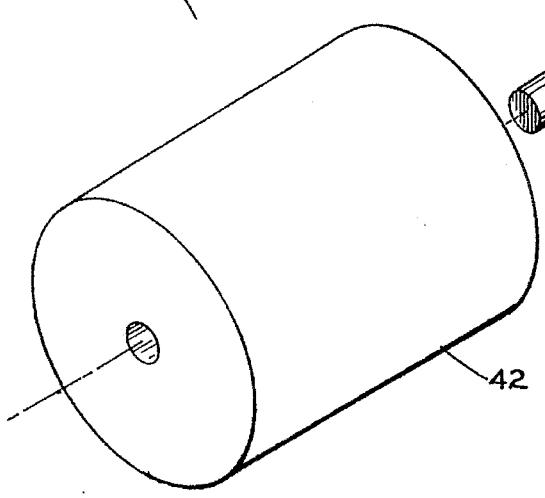
FIG. 1 is a perspective view of the inventive apparatus with the sleeve-shaped cushion spaced apart from and aligned with the support arm.
Figure 1:
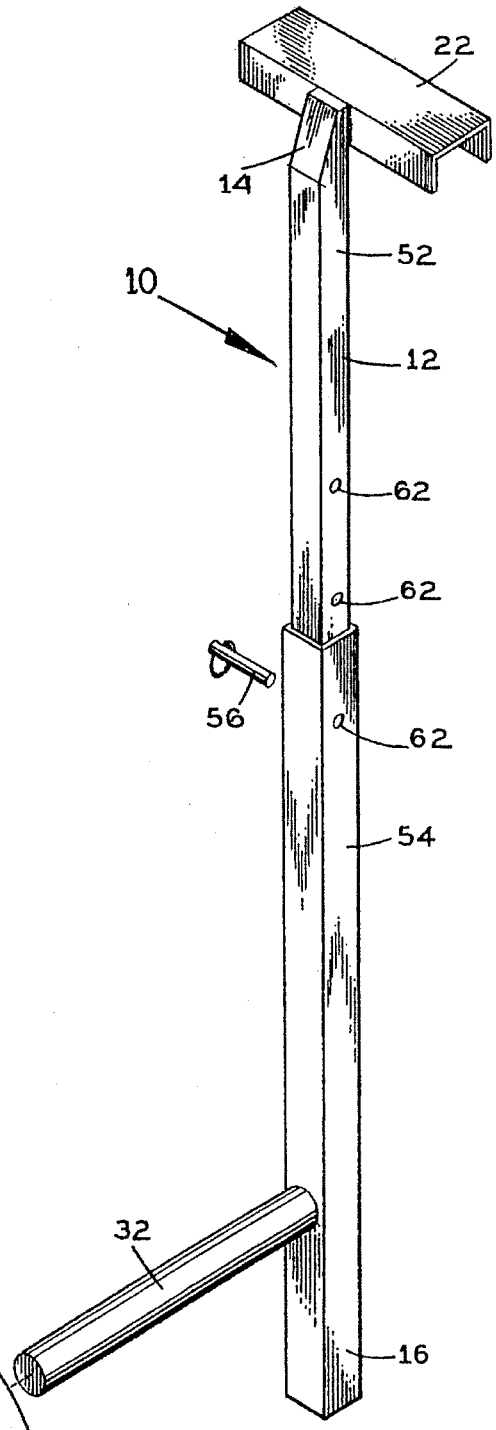
Figure 3:
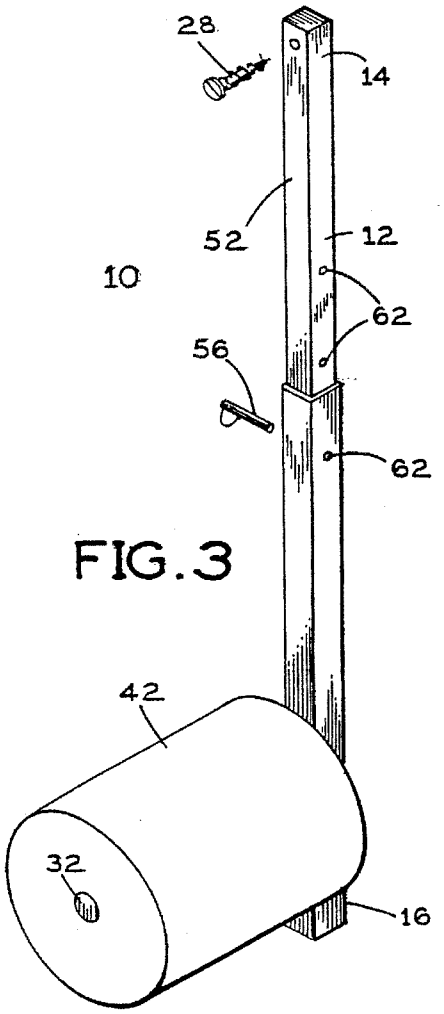
FIG. 3 is a view as in FIG. 1 except that a wall engagement fastener such as a wood screw or bolt is substituted for the hook structure.
Figure 4:
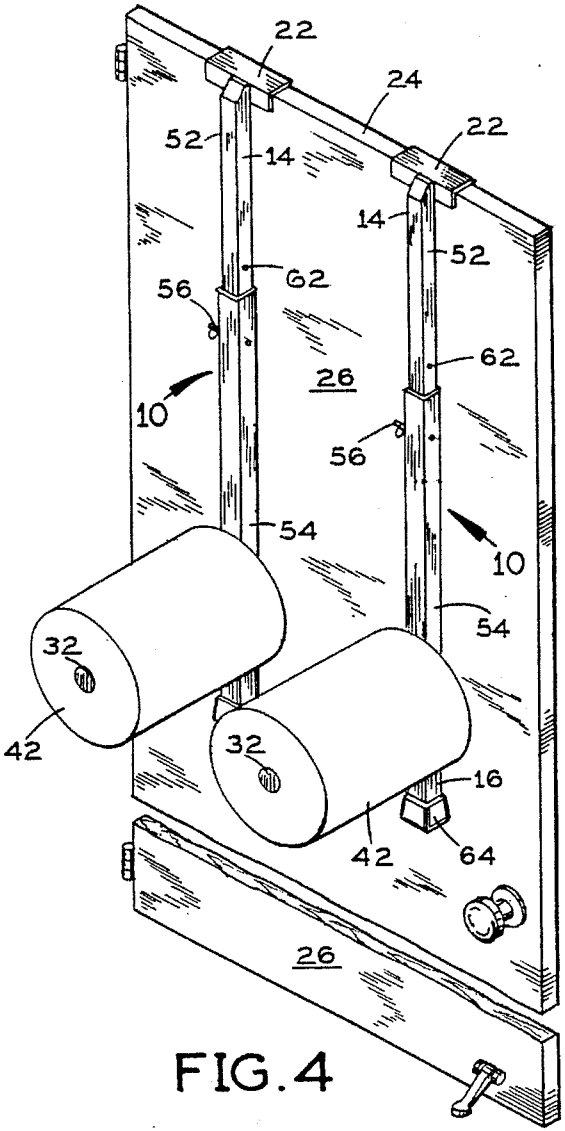
FIG. 4 is a perspective view of two of the inventive apparatus suspended from a door ready for use.
Figure 5:
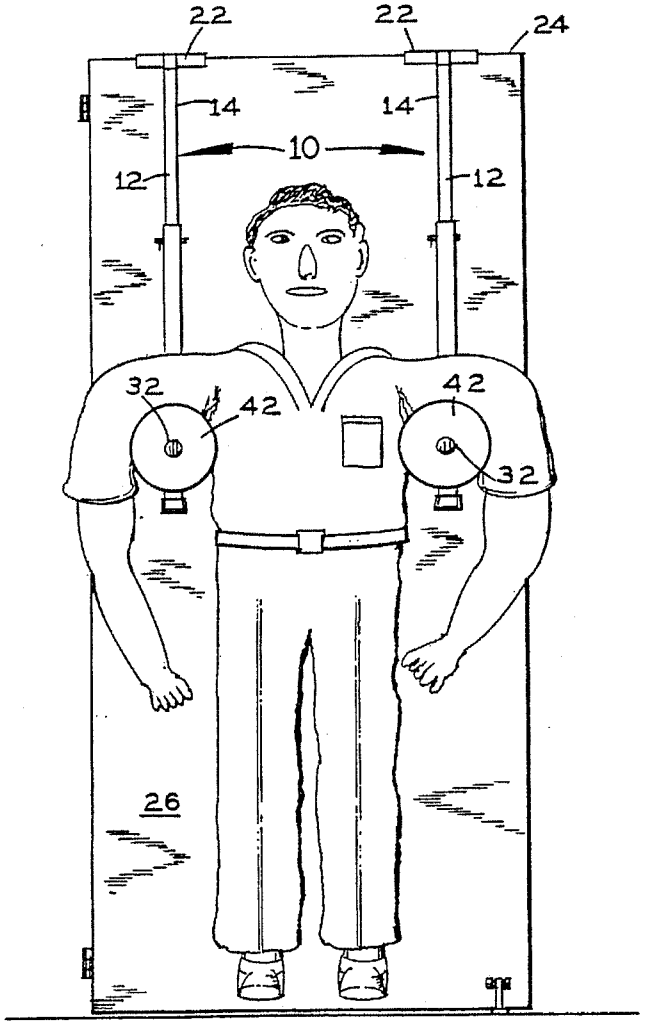
FIG. 5 is a front view of the two apparatus of FIG. 4 with a user suspended in traction from them.

Referring to FIGS. 1–5, a back stretching apparatus 10 is disclosed for applying traction to a user back. Apparatus 10 includes an elongate steel or aluminum suspension member 12 having a first member end 14 and a second member end 16. See FIG. 1. A hook structure 22 extends from first member end 14 in a first lateral direction for engaging an elevated portion of an apparatus support structure, such as the top rim 24 of a wall or a door 26. A steel or aluminum user support arm 32 for supporting a user extends from suspension member 12 in a second lateral direction opposite from the first lateral direction and away from door 26.

Suspension member 12 hangs vertically from top rim 24. Downward loading on support arm 32 causes suspension member 12 to pivot on hook structure 22 to abut and find support against door 26. See FIG. 2. Apparatus securing wall fasteners 28 may be substituted for hook structures 22. See FIG. 3.

The upper surface of support arm 32 is preferably covered with a cushion padding material. This material preferably takes the form of a thick foam sleeve 42 fit snugly and removably over support arm 32 to provide comfort and protection for the user.

Suspension member 12 is preferably formed of two telescoping tubular segments 52 and 54 interconnected by a removable locking pin 56 diametrically fit through mutually aligned pin ports 62 in tubular segments 52 and 54. Pin 56 equivalently may be a thumb screw and wing nut combination for convenient removal and replacement without tools. Tubular segments 52 and 54 each preferably have a square cross-section so that they do not rotate about their longitudinal axes relative to each other. A periodic series of opposing pin ports 62 are provided longitudinally along tubular segment 54 to make tubular segments 52 and 54 mutually engagable at a variety of discrete telescopic positions, to accommodate users of various heights.

Second member end 16 of suspension member 12 is preferably fitted with a protective cap 64 upon which apparatus 10 rests when standing in storage between uses, such as on a closet floor. Hook structure 22 is preferably a square channel attached to first end 14 perpendicular to suspension member 12, opening toward second end 16 and sized to closely fit over door top rim 24.

Method

In practicing the invention, the following method may be used. A method of apparatus 10 use is also provided, including the steps of hooking hook structures 22 of first and second apparatus 10 over an elevated portion of a door 26 such that suspension members 12 of the first and second apparatus 10 are laterally spaced apart from each other by a distance substantially equivalent to the width of the rib cage of the given user. See FIG. 4. A door stop or rubber wedge is placed under the free end of the door 26 for limiting stress on door 26 hinges. Then the user back is placed against door 26 between suspension members 12. The user raises his or her arms over and around support arms 32 and bends and transfers user weight from the user legs to support arms 32, thereby causing the weight of the user torso and user legs to pull downward on the spine and create traction. See FIG. 5. The user transfers user weight from the user legs to the apparatus support arms by either bending his or her knees or stepping off a prop such as a foot stool.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A portable and lightweight apparatus securable to a door for stretching the back and the spine of a user, the apparatus essentially consisting of:

a first elongate suspension member parallel to and unattached to a second elongate suspension member, each having a first tube telescoping into a second tube;

a first securing means for allowing the first tube and the second tube of the first elongate suspension member to be securable at discrete telescopic positions, a second securing means for allowing the first tube and the second tube of the second elongate suspension member to be securable at discrete telescopic positions.

a first hook structure extending from said first tube of the first elongate suspension member in a first lateral direction for engaging a top rim of a door, a second hook structure extending from said first tube of the second elongate suspension member in the first lateral direction for engaging the top rim of the door, the first hook structure parallel and unattached to the second hook structure, a first single support arm and a second single support arm parallel to and unattached to each other, the first single support arm and the second single support arm each having a connecting end secured to and extending from each of said second tubes in a second lateral direction substantially opposite from said first lateral direction, the first single support arm and the second single support arm each having a free extended end to project away from a face of the door, such that downward loading on both the first single support arm and the second single support arm causes said first suspension member and said second suspension member to pivot on said first and second hook structures to abut and find support against the face of the door, a first cushion sleeve for wrapping about the first support arm, and a second cushion sleeve for wrapping about the second support arm, wherein body weight of a user is supported solely by the user's arms and not the user's hands, by the first cushion sleeve and the second cushion sleeve.

2. The portable and lightweight apparatus of claim 1, wherein said first and said second securing means comprises:

a securing pin, and a plurality of diametrically opposing pairs of pin ports in both of the first and the second tubes for receiving said securing pin at said plurality of discrete telescopic positions.

3. The portable and lightweight apparatus of claim 1, wherein the first and the second securing means are chosen from at least one of:

bolts and screws.

* * * * *